US007181791B2

(12) United States Patent
Clayton

(10) Patent No.: US 7,181,791 B2
(45) Date of Patent: Feb. 27, 2007

(54) SURGICAL TABLE TRANSFER SYSTEM

(75) Inventor: Patrick Brian Clayton, Worthing (GB)

(73) Assignee: Eschmann Holdings Limited, West Sussex (GB)

( * ) Notice: Subject to any disclaimer, the term of this patent is extended or adjusted under 35 U.S.C. 154(b) by 206 days.

(21) Appl. No.: 10/507,504

(22) PCT Filed: Apr. 3, 2003

(86) PCT No.: PCT/GB03/01475

§ 371 (c)(1),
(2), (4) Date: Mar. 9, 2005

(87) PCT Pub. No.: WO03/086263

PCT Pub. Date: Oct. 23, 2003

(65) Prior Publication Data

US 2005/0150043 A1 Jul. 14, 2005

(30) Foreign Application Priority Data

Apr. 5, 2002 (GB) ..... 0207977.0

(51) Int. Cl.
*A61G 7/06* (2006.01)

(52) U.S. Cl. ..... 5/600; 5/86.1

(58) Field of Classification Search ..... 5/600, 5/86.1

See application file for complete search history.

(56) References Cited

U.S. PATENT DOCUMENTS 3,362,704 A * 1/1968 Pilz ..... 5/618
4,277,218 A 7/1981 Schweichler
5,083,331 A * 1/1992 Schnelle et al. ..... 5/600
5,279,011 A * 1/1994 Schnelle ..... 5/616
5,477,570 A * 12/1995 Hannant et al. ..... 5/86.1
5,651,150 A 7/1997 Kanitzer et al.

FOREIGN PATENT DOCUMENTS

DE 296 10 726 9/1996

* cited by examiner

*Primary Examiner*—Michael Trettel
(74) *Attorney, Agent, or Firm*—Louis Woo

(57) ABSTRACT

A surgical table transfer system comprising a patient support in the form of a table top; a surgical table base in the form of a pedestal; a transporter; and a connection device for selectively connecting the table top to the pedestal or the transporter, the connection device comprising a first transfer block mounted on the pedestal; a second transfer block mounted on the transporter; and a latch mechanism mounted on the table top and adapted selectively to latch with one of the first and second transfer blocks, the latch mechanism comprising a body having first and second opposite mating surfaces, each of which is adapted to mate with a corresponding mating surface of a respective first or second transfer block, and a displaceable catch member mounted on the body which is adapted to be displaceable between first and second latching positions for respective latching engagement with the first and second transfer blocks, the catch member having first and second catch elements on a respective opposite side thereof, each transfer block including a cavity for latching engagement therein of the respective catch element.

11 Claims, 4 Drawing Sheets

SURGICAL TABLE TRANSFER SYSTEM

The present invention relates to a surgical table transfer system.

It is known to provide a surgical table transfer system for minimising the disturbance and handling of patients during their transfer from a hospital bed to a surgical operation table. The handling of patients is minimised partly to minimise trauma to the patient and partly to minimise manual handling by hospital staff.

Such known surgical table transfer systems comprise a patient support in the form of a table top, defining an upper surface for supporting the patient, which is removably mounted on a transporter in the form of a wheeled trolley which is readily manoeuvrable. The transporter is used as a support for the surgical table top when used as a hospital bed. When the surgical table top is to be used as a surgical operation table, the surgical table top is removed from the transporter onto a surgical table base, also known as a pedestal. The pedestal can be operated so as to adjust the height of the surgical table top for the convenience of the hospital staff during the operation.

Such surgical table transfer systems are known for example from EP-A-0457246 (and its equivalent U.S. Pat. No. 5,083,331) and EP-A-0691117 (and its equivalent U.S. Pat. No. 5,611,638). These known systems incorporate trapezoidal connecting elements arranged on the opposed longitudinal side edges of the table top and which depend downwardly from the table top. The connecting elements may be received in complementary trapezoidal shaped receivers in the transporter and the pedestal. In order to provide a latching of the table top to the pedestal as well as to the transporter in order to prevent an unintended release of the table top from the particular support being used at the time, the connecting elements are each provided with a pair of longitudinally opposed latching members in the form of pivotally supported pawls. Each pawl is biased towards an outwardly pivoted position by a respective helical compression spring. The pawls are arranged to be selectively latched in an associated detent recess in the transporter or the pedestal. Sensors may be provided to determine whether each of the latching pawls is latched into its associated detent recess.

These known mobile surgical table transport systems suffer from the problem that the attachment devices between the table top on the one hand and the pedestal and the transporter on the other hand are complicated in construction, requiring a plurality of moving parts. Furthermore, there is also a need more easily to assist accurate locating of the table top relative to the pedestal or the transporter during the transfer operation when the table top is being transferred from the transporter to the pedestal or vice versa. Furthermore, despite the plurality of pawls on each side of the table top, only one pawl acts at any given time to prevent tipping in a given direction. Consequently, the table top can be rendered vulnerable to unintended release by the failure of a single pawl.

The present invention at least partially aims to overcome these problems with the prior art. The present invention aims to provide an improved surgical table transport system, in particular having a more simplified and reliable locking and location mechanism between the table top, the pedestal and the transporter.

Accordingly, the present invention provides a surgical table transfer system comprising a patient support in the form of a table top; a surgical table base in the form of a pedestal; a transporter; and a connection device for selectively connecting the table top to the pedestal or the transporter, the connection device comprising a first transfer block mounted on the pedestal; a second transfer block mounted on the transporter; and a latch mechanism mounted on the table top and adapted selectively to latch with one of the first and second transfer blocks, the latch mechanism comprising a body having first and second opposite mating surfaces, each of which is adapted to mate with a corresponding mating surface of a respective first or second transfer block, and a displaceable catch member mounted on the body which is adapted to be displaceable between first and second latching positions for respective latching engagement with the first and second transfer blocks, the catch member having first and second catch elements on a respective opposite side thereof, each transfer block including a cavity for latching engagement therein of the respective catch element.

Embodiments of the present invention will now be described, by way of example only, with reference to the accompanying drawings, in which.

Figure 1:
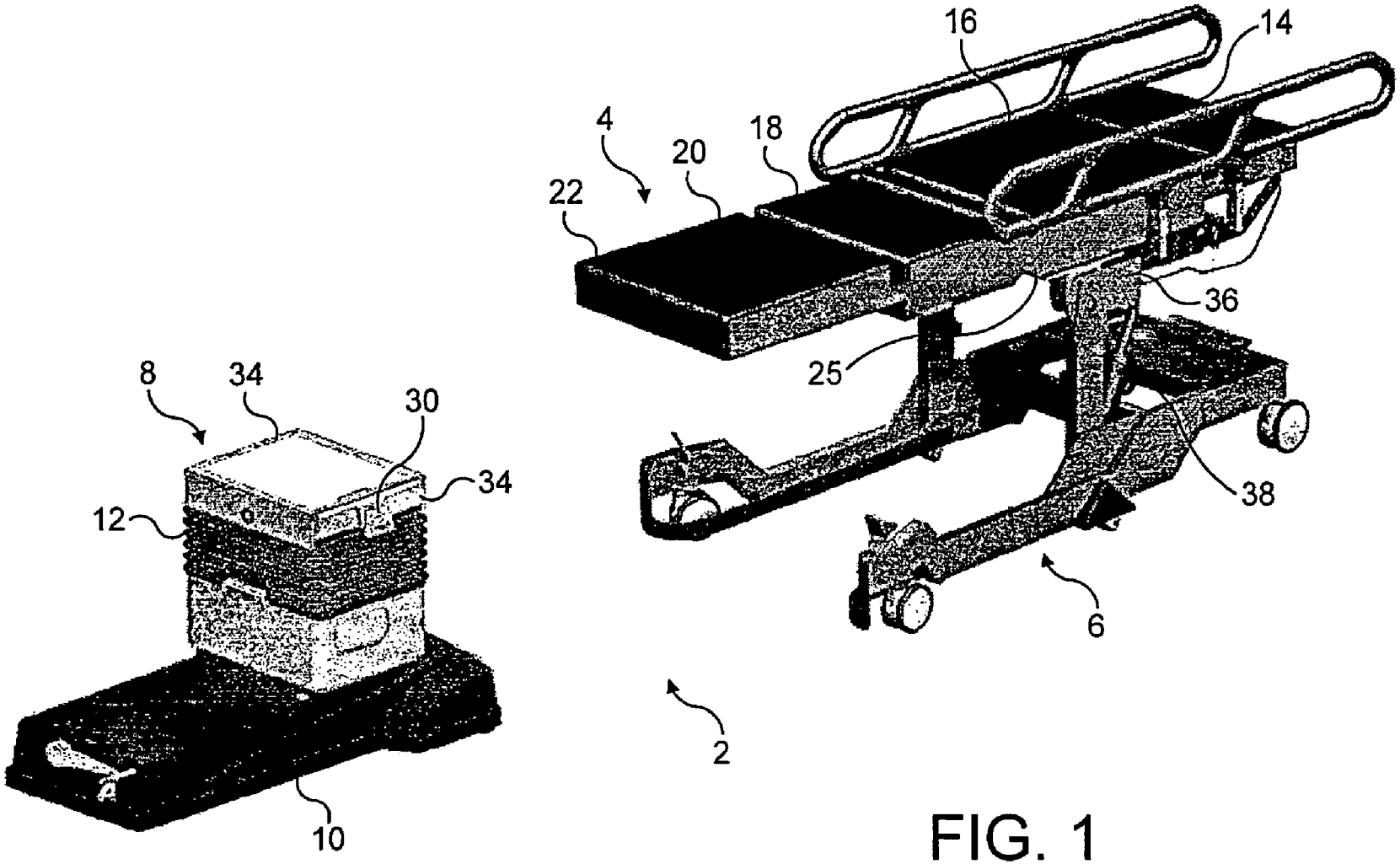
FIG. 1 is a perspective view of a surgical table transport system including a surgical table top, shown removably mounted on a transporter, and a surgical table pedestal in accordance with an embodiment of the present invention.
Figure 5:
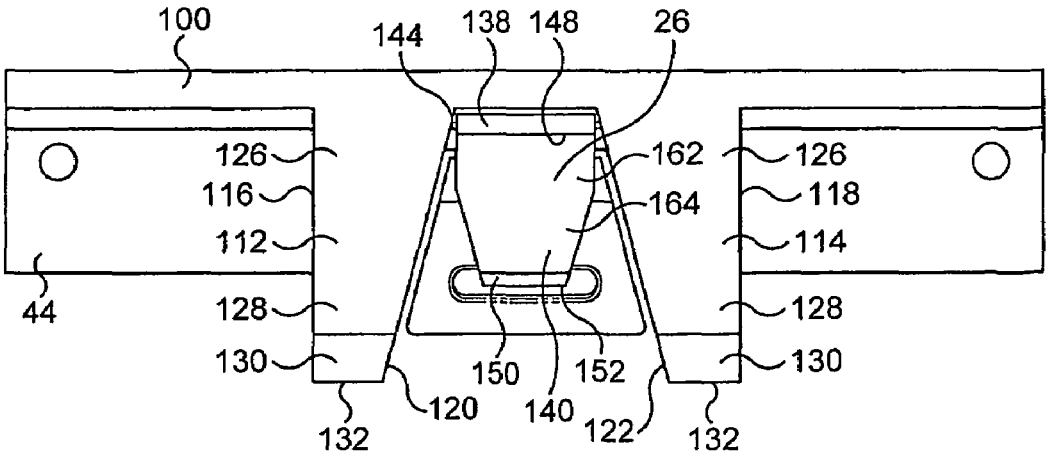
Figure 6:
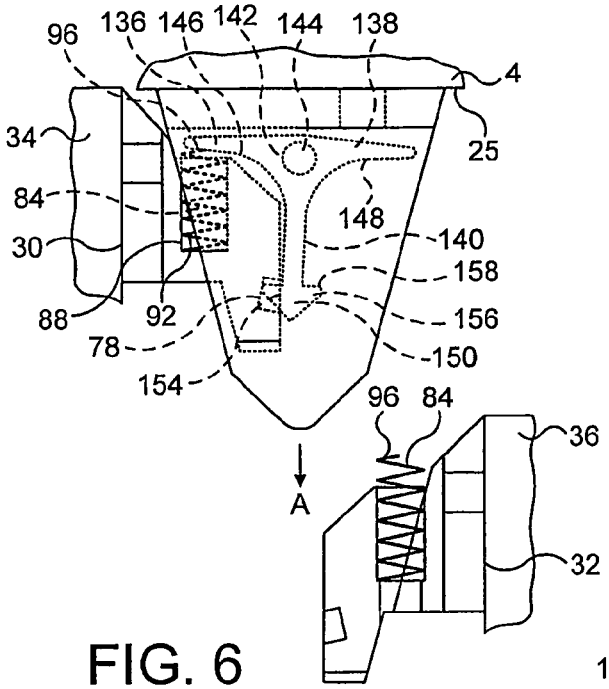
Figure 7:
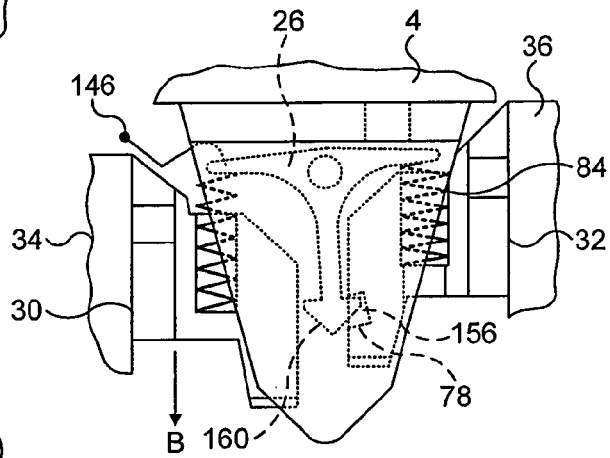
Figure 8:
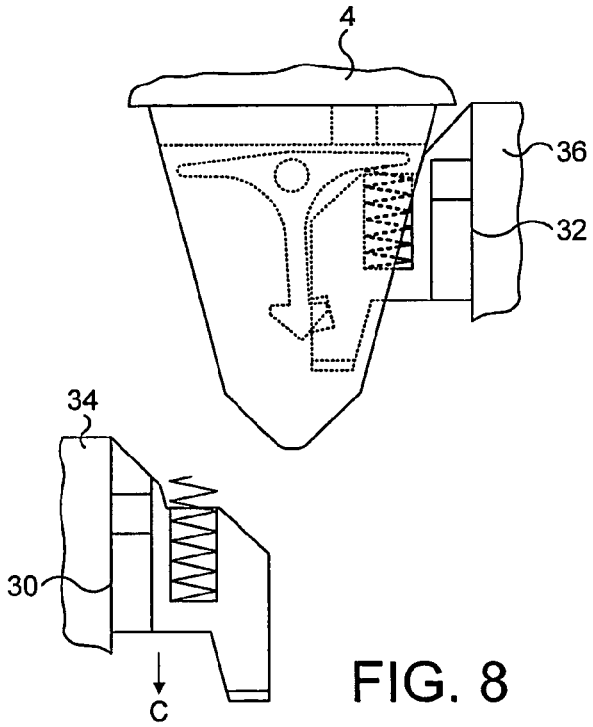

FIG. 5 is a front view of one of the transfer blocks when latched with the catch member of the latch mechanism of the system of FIG. 1; and FIGS. 6, 7 and 8 are schematic end views, partly in phantom, of the transfer blocks of the pedestal and the transporter and the latch mechanism on the table top illustrating sequential steps in the transfer of the table top from the transporter to the pedestal and vice versa.

Referring to FIG. 1 there is shown a surgical operation table transport system, designated generally as 2, in accordance with an embodiment of the present invention. The surgical table transfer system 2 comprises a surgical table top 4 which is removably mounted on a wheeled transporter 6, otherwise known as a trolley, which is readily manoeuvrable and yet provides a secure base for the surgical table top 4 when it is used as a hospital bed. The surgical operation table transport system 2 further includes a surgical operation table pedestal 8, also known as a table base, which stands on the floor. Typically, a surgical operation table transport system normally comprises one pedestal in conjunction with two table tops and two transporters. The pedestal 8 includes a base portion 10, which is provided with wheels or casters (not shown) which provide some limited manoeuvrability to the pedestal 8, and a column 12 of adjustable height mounted on the base portion 10. The height of the column 12 may be adjusted either hydraulically or electrically. The table top 4 is divided into four sections, namely a head section 14, an upper torso section 16, a lower torso section 18 and a leg section 20. Together, the four sections define a patient support surface 22. The sections 14, 16, 18, 20 can be pivoted relative to each other so as to adjust the relative angle of the sections, and thereby the shape and configuration of the patient support surface 22.

Figure 2:
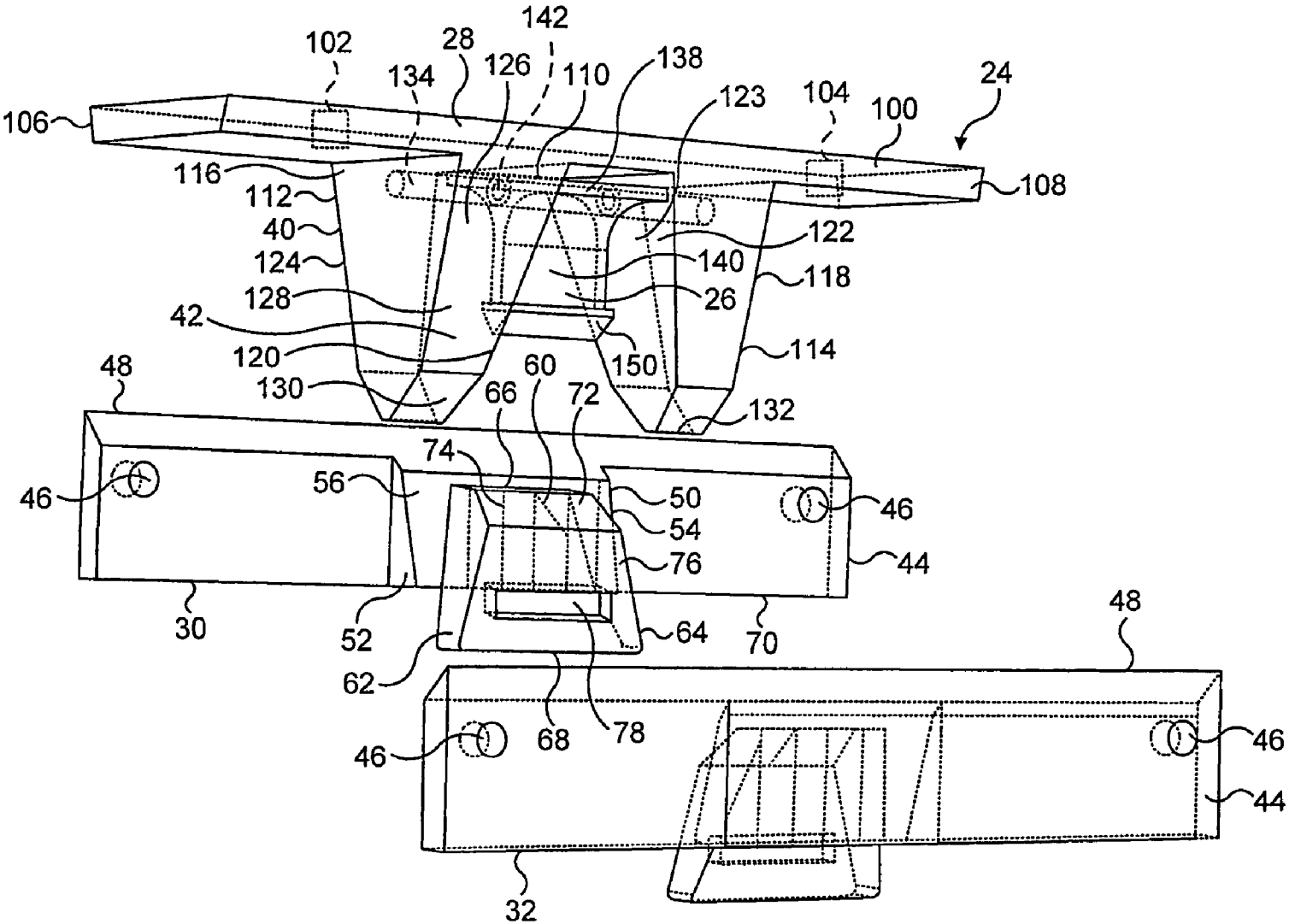
FIG. 2 is a perspective enlarged schematic view, partly in phantom, and in a dissembled configuration, of a pair of transfer blocks for respective mounting on the pedestal and on the transporter and a latch mechanism for cooperation therewith for mounting on the table top of the system of FIG. 1.
Figure 3:
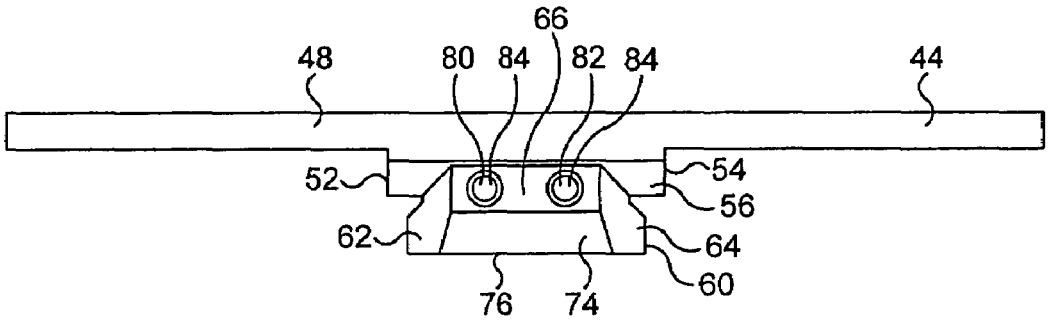
FIGS. 3 and 4 are, respectively, plan and front views of the transfer blocks of FIG. 2.
Figure 4:
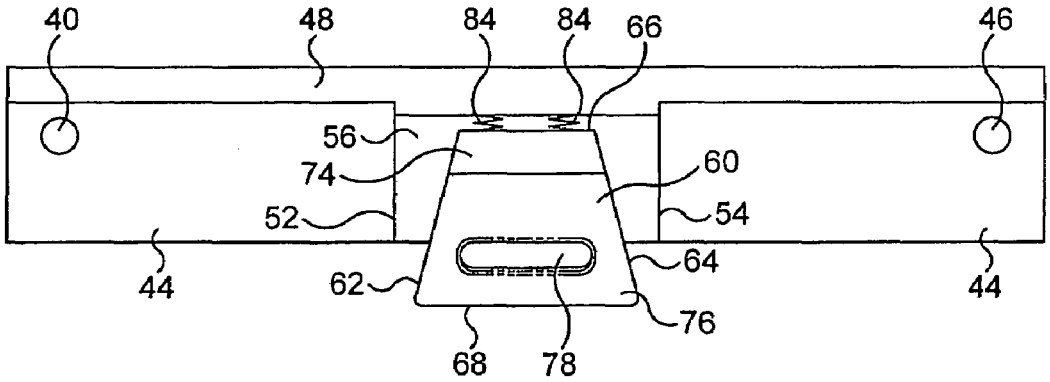

An under surface 25 of the upper torso section 16 of the table top has mounted thereon, on opposite sides thereof, a pair of spaced, longitudinally oriented, downwardly depending latch mechanisms 24 as shown in greater detail in FIG. 2. Each latch mechanism 24 includes a catch member 26 and a catch support member 28. Each catch support member 28 has pivotally mounted thereon a respective catch member 26. Each latch mechanism 24 is configured selectively to cooperate and latch with a respective longitudinally oriented transfer block 30,32 provided both on the column 12 of the pedestal 8 and on the transporter 6.

The pedestal transfer blocks 30 are provided on respective opposite longitudinally directed upper edges 34 of the column 12, so as to be laterally outwardly directed. Conversely, the transfer blocks 32 on the transporter 6 are longitudinally mounted on respective opposite upper edges 36 of a frame member 38 of the transporter 6 and are laterally inwardly directed. There are thus provided two pairs of cooperating transfer blocks 30,32, each pair 30,32 being on a respective opposite side of both the pedestal 8 and the transporter 6. A single pair of transfer blocks 30,32 is illustrated in FIG. 2. Each transfer block 30,32 of a pair is adapted to cooperate with a respective opposite side 40,42 of latch mechanism 24 which is received between the opposed transfer blocks 30,32 of the pair when the table top 4 is being transferred from the transporter 6 to the pedestal 8 or vice versa.

Referring in detail to FIGS. 2 to 5, the transfer blocks 30,32 mounted on the pedestal 8 and the transporter 6 have the same structure and configuration. The transfer blocks 30,32 of each cooperating pair face each other in a mirror-symmetrical manner during transfer of the table top 4 when the latch mechanism 24 is located between the two transfer blocks 30,32. Each transfer block 30,32 includes a longitudinally oriented elongate backing plate 44 provided with a pair of longitudinally separated mounting holes 46 by means of which the backing plate 44 is securely affixed, for example by threaded bolts (not shown), to the upper longitudinal edge 36,34 of the respective transporter 6 or pedestal 8. The uppermost face 48 of the backing plate 44 of the transfer block 30,32 is downwardly and forwardly chamfered to provide an inclined surface 48, typically inclined at an angle of 45° to the horizontal. At the centre of the backing plate 44 is provided an integral forwardly directed chamfered extension 50 defining a pair of forwardly directed opposed side faces 52,54 and therebetween a downwardly and forwardly directed lower inclined face 56 which is typically inclined at an angle of 75° to the horizontal. In addition, at the centremost part of the inclined face 56 is provided an integral forwardly-directed trapezoidal or wedge shaped support member 60.

The trapezoidal support member 60 includes two opposite side faces 62,64 which are each inclined to the vertical, typically at an angle of 15°, so as to define an upwardly pointing trapezoidal shape, with the upper and lower edges of the trapezoidal shape being defined by a planar upper horizontal surface 66 and an opposite planar lower horizontal surface 68 of the trapezoidal support member 60. The lower surface 68, and correspondingly a lower part of each of the two opposite side faces 62,64, are disposed below a bottom edge 70 of the backing plate 44. The front face 72 of the trapezoidal support member 60 consists of a downwardly and forwardly inclined upper surface 74, typically inclined at an angle of 45° to the horizontal, and a vertical lower surface 76 defining the major portion of the front face 72 of the trapezoidal support member 60. A lower part of the vertical surface 76 is provided with one or more inwardly recessed horizontally oriented elongate recesses 78.

Each transfer block 30,32 is provided with one or more longitudinally spaced downwardly extending cylindrical bores 80,82 which extend downwardly from the planar upper surface 66 of the trapezoidal support member 60. As shown in FIGS. 6 to 8, a compression sprung element 84 is received in each bore 80,82, the upper end 96 of each sprung element 84 extending, in the relaxed configuration, above the planar upper surface 66.

Each latch mechanism 24 which is mounted on the under surface 25 of the table top 4 includes a horizontal longitudinally oriented elongate backing plate 100 having respective mounting holes 102,104 at the opposite longitudinal ends thereof for securely fixing the latch mechanism 24 to the table top 4 by means of, for example, threaded bolts (not shown). Each longitudinally directed face 106,108 of the backing plate 100 is downwardly and inwardly inclined so as to be matable with the correspondingly inclined uppermost face 48 of the backing plate 44 of each transfer block 30,32.

At the longitudinal centre of the backing plate 100, is disposed a downwardly directed catch support assembly 110 comprising a pair of longitudinally spaced catch support members 112,114 with a movable catch member 26 being disposed therebetween. The longitudinally outwardly facing surfaces 116,118 of the two catch support members 112,114 are vertical. The longitudinally inwardly facing opposed surfaces 120,122 of the two catch support members 112,114 are downwardly and outwardly inclined relative to the vertical so as to define therebetween a trapezoidal, or wedge shaped, recess 123 for mating reception therein of the trapezoidal support members 60 of the transfer blocks 30,32, each on a respective side of the recess 123. Typically, the surfaces 120,122 are inclined at an angle of 10° to the vertical.

The pair of longitudinally directed, laterally facing, faces 124,126 of each catch support member 112,114 each include a major upper inclined portion 128 and a minor lower inclined portion 130 which together for both faces 124,126 define a downwardly pointed tip 132 of each catch support member 112,114. The two opposite upper inclined portions 128 are both downwardly and inwardly inclined, typically at an angle of 15° to the vertical, and the two opposite lower inclined portions 130 are also downwardly and inwardly inclined typically at an angle of 45° to the vertical, so as to terminate in the pointed tip 132 of the catch support member 112,114.

The catch member 26 is longitudinally mounted in the recess 123 and pivotally mounted about a longitudinally directed axis 134 extending between the opposed facing surfaces 120,122 of the catch support members 112,114. The catch member 26 is freely pivotally mounted and is unbiased in any particular direction. The catch member 26 has a substantially T-shaped cross-section, with a pair of opposite outwardly directed arms 136,138 at the top thereof and an integral centrally downwardly depending leg 140. The axis 134 is orthogonal to the arms 136,138 and the leg 140. At the junction of the arms 136,138 and the leg 140 is provided a longitudinally oriented elongate bore 142 through which an elongate catch pin 144 extends, with the catch pin 144 being securely affixed, for example by threaded bolts (not shown), at each end thereof to a respective catch support member 112,114. The catch member 26 can be freely pivoted in a rocking motion about the catch pin 144. Each arm 136,138 includes a downwardly facing bearing surface 146,148 which is adapted to cooperate with the upper end of each of the sprung elements 84 mounted in the respective transfer block 30,32. The leg 140 of the catch member 26 is provided with a downwardly pointed arrowhead-section foot 150 at the bottom end 152 thereof including two opposed longitudinally oriented laterally outwardly facing catch elements 154,156, each catch element 154,156 including an upper planar portion 158 and a lower downwardly and inwardly inclined portion 160, with each catch element 154,156 being shaped and configured so as to be received in a respective recess 78 of a transfer block 30,32.

The length, in a longitudinal direction, of the catch member 26 is, for the upper portion thereof comprising the arms 136,138 and an upper part 162 of the leg 140, slightly less than that of the trapezoidal recess 123 at the upper edge thereof. The two sides of the leg 140 taper inwardly to provide a reduced width at a lower part 164 of the leg 140.

It will be apparent to those skilled in the art that the shape, geometry and configuration of the various interconnecting or engaging elements employed in the present invention may be modified or varied without departing from the invention.

The operation of the surgical table transfer system in accordance with the embodiment of the invention will now be described with particular reference to FIGS. 6 to 8.

FIG. 6 schematically shows the transfer block 30, which is one of the pair thereof affixed to the pedestal 8, in the configuration with the transfer block 30 supporting and being in latching engagement with one of the latch mechanisms 24 of the pair thereof which are affixed to the table top 4. As may be seen from FIG. 6, in the latching configuration, the catch element 154 is received within the recess 78 of the transfer block 30 as a result of the upwardly directed bias on the surface 146 of the arm 136 by the upper end 96 of the sprung element 84 bearing thereagainst, which, in FIG. 6, urges the catch member 26 in a clockwise direction. This in turn urges the catch element 154 into the recess 78, which securely latches the table top 4 relative to the pedestal 8, and prevents inadvertent relative vertical movement therebetween.

As shown in FIG. 6, when it is desired to transfer the table top 4 onto the transporter 6 from the pedestal 8, the column 12 of the pedestal 8 is initially raised to a sufficient height so that the transporter 6 can be manoeuvred beneath the table top 4. The transporter 6 is manoeuvred so that the transfer blocks 30,32 affixed thereto are disposed beneath the respective latch mechanism 24. There is no need accurately to dispose the transfer blocks 30,32 directly underneath the latch mechanism 24, because the provision of the inclined surfaces 48 on the backing plate 44 of the transfer blocks 30,32 on the one hand and the inclined surfaces 130 and 128 on the catch support members 112,114 on the other hand permit sliding movement therebetween. This can cause relative lateral movement between the latch mechanism 24 and the transfer blocks 30,32 which in turn can laterally finely position the transporter 6 accurately relative to the table top 4 and to the pedestal 8. As shown in FIG. 6, when the transfer blocks 32 have been positioned generally beneath the latch mechanism 24, the table top 4 is then lowered by lowering of the column 12 of the pedestal 8 as shown by arrow A.

As shown in FIG. 7, when the latch mechanism 24 is lowered onto the transfer block 32, the upper end 96 of the sprung element 84 is urged against the bearing surface 148 of the arm 138 which causes compression of the sprung element 94 from its previously extended configuration. With reference to FIG. 7, this causes anticlockwise movement of the catch member 26 as the load of the table top 4 is transferred to the transfer block 32 from the transfer block 30 which is then released on continued downward movement of the column 12 as shown by the arrow B. That anticlockwise motion causes the catch element 156 to be latched in the recess 78 of the transfer block 32. This in turn assures secure latching between the table top 4 and the transporter 6, preventing relative vertical movement therebetween.

As shown in FIG. 8, on continued downward movement of the column 12 of the pedestal 8 and the transfer block 30 mounted thereon in the direction of arrow C, the table top 4 carried on the latch mechanism 24 is released from the pedestal 8 by de-engaging of the transfer block 30 from the latch mechanism 24. The table top 4 is accordingly supported by the transporter 6. When the column 12 of the pedestal 8 has been moved sufficiently downwardly that the transfer block 30 is below the latch mechanism 24, the transporter 6 carrying the table top 4 can be wheeled away from the pedestal 8.

It will be clear to a person skilled in the art that when it is desired to transfer the table top 4 from the transporter 6 back onto the pedestal 8, a reverse sequence of steps occurs.

The invention claimed is:

1. A surgical table transfer system comprising a patient support in the form of a table top; a surgical table base in the form of a pedestal; a transporter; and a connection device for selectively connecting the table top to the pedestal or the transporter, the connection device comprising a first transfer block mounted on the pedestal; a second transfer block mounted on the transporter; and a latch mechanism mounted on the table top and adapted selectively to latch with one of the first and second transfer blocks, the latch mechanism comprising a body having first and second opposite mating surfaces, each of which is adapted to mate with a corresponding mating surface of a respective first or second transfer block, and a displaceable catch member mounted on the body which is adapted to be displaceable between first and second latching positions for respective latching engagement with the first and second transfer blocks, the catch member having first and second catch elements on a respective opposite side thereof, each transfer block including a cavity for latching engagement therein of the respective catch element.

2. A surgical table transfer system according to claim 1 wherein the catch member has a substantially T-shaped cross-section and comprises a pair of opposite outwardly directed arms and a leg, the catch member being pivotally mounted to the body about an axis orthogonal to the arms and the leg.

3. A surgical table transfer system according to claim 2 wherein the catch member is freely pivotally mounted to the body and is unbiased in any particular direction.

4. A surgical table transfer system according to claim 2 wherein the catch elements are disposed at a foot at an end of the leg.

5. A surgical table transfer system according to claim 2 wherein the arms of the catch member each define a respective bearing surface, each bearing surface being adapted to be engaged by a respective transfer block, thereby to be urged upwardly to pivot the catch member about the axis thereby to latch one of the catch elements in the cavity of that respective transfer block.

6. A surgical table transfer system according to claim 5 wherein each transfer block is provided with at least one biasing element which is adapted to be urged against the respective bearing surface to cause pivoting of the catch member when the respective transfer block supports the latch mechanism.

7. A surgical table transfer system according to claim 6 wherein the biasing element comprises one or more sprung components disposed in a bore of the transfer block, an end of the sprung components extending, in an unbiased configuration, above a surface of the transfer block for engagement with the catch member.

8. A surgical table transfer system according to claim 1 wherein the body defines a trapezoidally shaped recess in which the catch member is mounted, and each transfer block is provided with a correspondingly trapezoidally shaped support member for mating engagement with the recess.

9. A surgical table transfer system according to claim 8 wherein the trapezoidal shape of the recess and the trapezoidal shape of the support members point upwardly.

10. A surgical table transfer system according to claim 1 wherein the body of the latch mechanism includes two downwardly depending longitudinally spaced catch support members between which the catch member is mounted, each catch support member having a pair of opposite lateral faces which are downwardly and inwardly inclined, and each transfer block has a pair of longitudinally spaced lateral faces which are downwardly and outwardly inclined, the lateral faces of both the catch support members and the transfer blocks being adapted to permit relative sliding motion therebetween for assisting lateral location of the transfer blocks relative to the latch mechanism during relative vertical movement therebetween.

11. A surgical table transfer system according to claim 10 wherein the inclined lateral faces of the catch support members each comprise an upper portion and a lower portion, the lower inclined portion being inclined at a greater angle to the vertical than the upper portion, and each inclined lateral face of the transfer block comprises an upper portion and a lower portion, the upper portion being inclined at a greater angle to the vertical than the lower portion.

* * * * *